United States Patent [19]

Boogers

[11] Patent Number: 4,495,955

[45] Date of Patent: Jan. 29, 1985

[54] WINDING DEVICE

[75] Inventor: Wilhelmus P. L. Boogers, Eindhoven, Netherlands

[73] Assignee: P.M.B. Patent Machinebouw B.V., Best, Netherlands

[21] Appl. No.: 276,788

[22] Filed: Jun. 24, 1981

[30] Foreign Application Priority Data

Jul. 11, 1980 [NL] Netherlands ..... 8004023

[51] Int. Cl.[3] ..... A24C 1/28; A24C 1/02

[52] U.S. Cl. ..... 131/105

[58] Field of Search ..... 131/105, 27 R, 28, 58

[56] References Cited

U.S. PATENT DOCUMENTS 3,542,038 11/1970 Hooper et al. ..... 131/105

FOREIGN PATENT DOCUMENTS 0494056 6/1970 Belgium ..... 131/105

2025752 1/1980 United Kingdom ..... 131/105

2067968 8/1981 United Kingdom ..... 131/105

*Primary Examiner*—V. Millin

*Attorney, Agent, or Firm*—Diller, Ramik & Wight

[57] ABSTRACT

A device for storing tobacco leaves or parts thereof in a winding belt or a bobbin, mainly comprising a frame having at least one deposition table formed like a suction box (1) having separate sections and a run-on and a run-off rim, a reel (4) for the winding belt adapted to reciprocate with respect to the run-off rim of the table and a rotatable driving element formed like a roller and associated with each table and having its rotary axis arranged parallel to that of the reel freely rotatable in the frame, which roller presses against the bobbin circumference and is adapted to advance the belt across the table and to wind it on the reel whereas the tightening force experienced by the tape during the winding operation is determined by belt-engaging braking means (11, 19) in front of the run-on rim of the table.

10 Claims, 2 Drawing Figures

WINDING DEVICE

Figure 1:
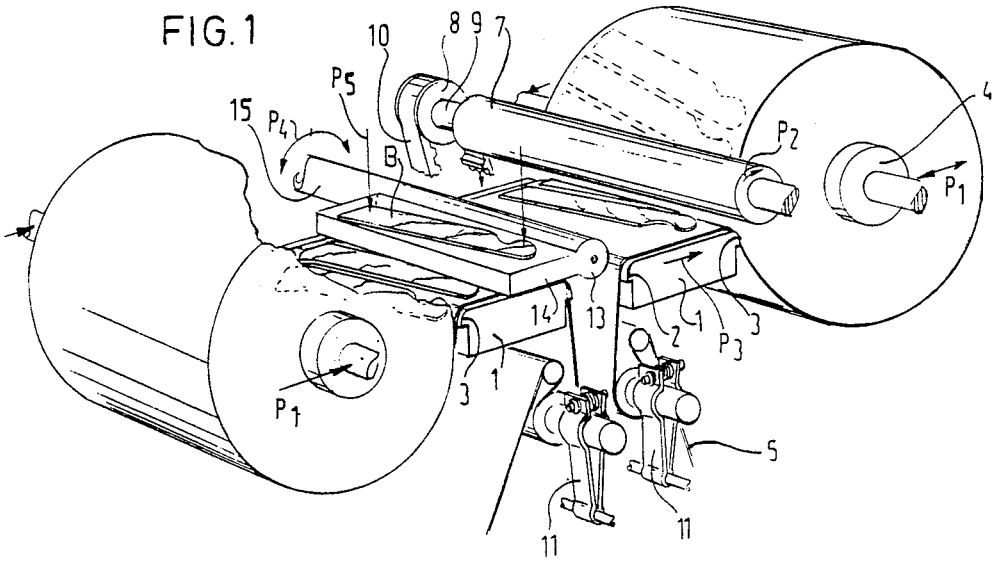

The invention relates to a device for storing tobacco leaves or parts thereof in a winding belt or a bobbin, mainly comprising a frame having at least one deposition-table with a run-on and run-off rim, a reel for the winding belt adapted to reciprocate with respect to the run-off rim of the table and driving means for advancing the belt across the table and for winding it on the reel.

The invention has for its onject to improve the driving means of the winding device of the kind set forth in a manner such that at any thickness of the reel, that is to say, independently of the number of turns, the driving force remains the same. This is important to maintain the equality of the pressing force between the turns exerted on the sandwiched leaf portions so that changes of said leaf portions during storage are minimized.

The device according to the invention is distinguished in that the driving means are provided with a rotatable driving element associated with each table and having its rotary axis arranged parallel to that of the reel freely rotatable in the frame.

Thanks to this rotatable driving element at the circumference of the reel the driving force will now only depend on the friction between the driving element and the material of the reel, that is to say, of the belt. The variation in diameter of the reel then does not play any part because central drive of the reel is despensed with.

In a preferered embodiment the driving element is formed by a roller arranged near the table and covering the width thereof. This has the advantage that only the reel of the bobbin need be resiliently arranged in the frame, whilst the roller may have a fixed position relative to the table.

The tightening force experienced by the belt during the winding operation is also determined by the friction between the belt and the surface of the table across which the belt is drawn. In order to be able to raise the tightening force the invention suggests to provide belt-engaging braking means in front of the run-on rim of the table.

The table is preferably constructed in the form of a perforated wall of a suction box by which the product can be temporarily held by suction on the belt prior to being clamped tight between the turns.

In order to reduce the "air consumption" of such a suction box it is provided with two separate suction sections so that during the stepwise advance of the belt one section can each time be switched off, if no leaf is present.

Figure 2:
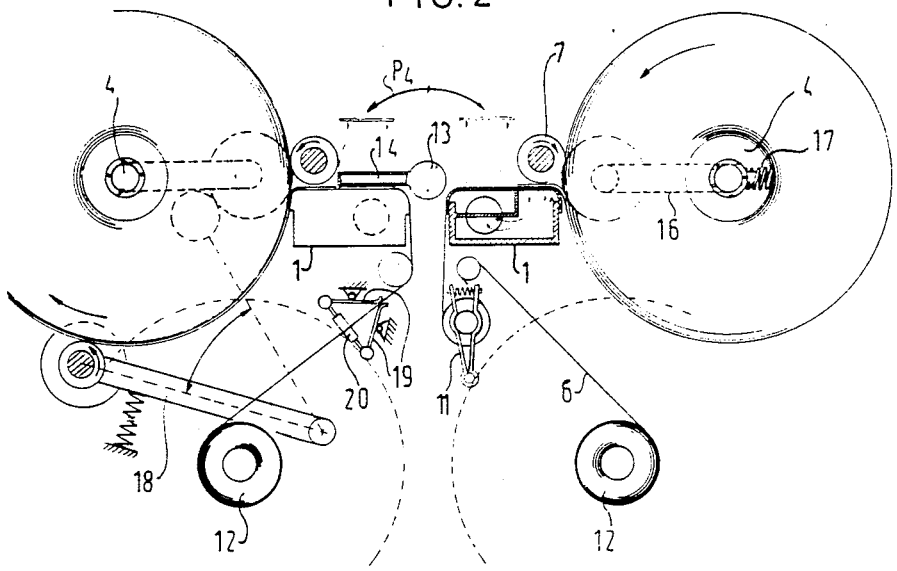

The invention will be described more fully with reference to the specification of embodiments. The drawing shows in:

FIG. 1 a perspective view of a first embodiment of a double device in accordance with the invention, FIG. 2 a schematic side elevation of the device comprising various alternative driving and braking means, The device shown in FIG. 1 comprises two suction boxes 1 arranged side by side, the top face of which is perforated, so that, when each box is connected with a source of vacuum (not shown), air can be sucked in from above.

The table is provided with a run-on rim 2 and a run-off rim 3, the bobbin reel 4 being adapted to shift with respect to the latter, that is to say, in the direction of the arrow P 1. This movement may be carried out in any appropriate manner, that is to say, pneumatically, hydraulically or else mechanically by means of springs, which is illustrated schematically in FIG. 2. This movement serves to constantly hold the outermost winding of the reel near the run-off rim 3 so that, when the belt 6 is wound up, the belt portion on the table comes substantially directly into contact with the outermost winding.

The reel is driven by means of a roller 7 covering the full width of the table 1, said roller being rotatably journalled by the shaft 9 in a frame (not shown). The toothed disc 8 with a toothed belt 10 arranged on the shaft 9 ensures the rotation in the direction of the arrow P2. The toothed belt 10 is driven by any suitable motor of constant torque. An identical motor drives the second roller (not shown) for the left-hand reel of FIG. 1.

Owing to the rotation of the driving roller 7 in the direction of the arrow P2 the belt is drawn across the table in the direction of the arrow P3. With respect to said advance direction is arranged in front of the run-on rim 2 a braking member in the form of a roller braked by the block brake 11. When the belt 7 is drawn off a stock reel 12 (see FIG. 2), this stock reel may be freely rotatably suspended in the frame. The braking roller provides the desired tensile force in the belt portion along the table 1, when the belt is wound on the reel to form the bobbin.

In the embodiment shown in FIG. 1 the two tables with the associated reel are arranged in specular fashion and a transfer member 13 is formed by a suction box 14 fastened to a rotatable shaft 15 adapted to swing reciprocatorily in the direction of the arrow P4. The disposition is such that by the reciprocatory swing the suction box 14 can be alternately brought above the left-hand and the right-hand table respectively. Such a transfer member has the advantage that a single feeding member for the tobacco leaf portions B will be sufficient, since the feeding member (not shown) generally known in the tobacco industry as a leaf transport carrier, need, each time, deposit the leaf portions in the direction of the arrows P5 either on a side of the suction box 14 or on the top face of the left-hand table 1 of FIG. 1. By changing over the transfer member 13 a leaf portion is deposited out of the position shown in FIG. 1 on the right-hand table 1. In this position the left-hand table 1 becomes free so that the feeding member can directly deposit a leaf portion on the left-hand table. With such a disposition the feeding rate can be markedly increased.

FIG. 2 shows partly in a side elevation the embodiment of FIG. 1, in particular the right-hand side thereof. From this Figure it will be apparent that the reel 4 is pre-stressed by means of a straight guide 16 in the direction towards the run-off rim 3 of the table 1 by means of the springs 17. At an increase in the bobbin diameter on the reel 4 the shaft will move to the right against the force of the spring 17. Since the driving roller 7 is arranged near the table 1, it can be fixedly journalled in the frame without the need for being yielding. Nevertheless the driving roller may be arranged on a swinging arm system 18 in order to ensure the desired winding of the belt material on the reel 4 (see the left-hand side of FIG. 2).

The suction box 1 of FIG. 2 has two separate compartments so that the perforated top face is separated into two sections viewed in the transport direction. When the transfer member 13 swings away, the part of the table not bearing a tobacco leaf portion can be temporarily switched off, resulting in a reduction of air consumption.

The braking means 11 formed by a braking roller (see the right-hand side of FIG. 2) may be replaced by two clamping plates 19, which are pivoted by a pneumatic ram 20 in a manner such that the opposite rims of the plates 19 engage one another by clamping force, thus retaining the belt portion 6 as a result of friction. The plates may extend throughout the width of the belt 6 and be suitable journalled in the frame.

The invention is not limited to the embodiments depicted above. For example, the driving roller 7 may be replaced by a shaft provided with a plurality of parallel discs arranged side by side. As a matter of course, only half of the embodiment shown may be employed, that is to say, only one suction table with one associated winding reel.

What is claimed is:

1. A device for storing tobacco leaves or portions thereof in a winding belt or bobbin, mainly comprising a frame having at least one deposition table having a run-on and a run-off rim, a reel for the winding belt adapted to reciprocate with respect to the run-off rim of the table and driving means for advancing the belt across the table and for winding it on the reel characterized in that the driving means are provided with the table and having its rotary axis arranged parallel to that of the reel freely rotatable in the frame.

2. A device as claimed in claim 1 characterized in that the driving element is a roller arranged near the table and covering the width thereof.

3. A device as claimed in claim 1 or 2 characterized in that belt-engaging braking means are arranged in front of the run-on rim of the table.

4. A device as claimed in claim 1 or 2 characterized in that the table is formed by the perforated wall of a suction box.

5. A device as claimed in claim 4 characterized in that the suction box comprises two separate suction sections.

6. A device as claimed in claim 1 or 2 characterized in that each time two tables with the associated winding reels are disposed opposite one another in specular fashion.

7. A device as claimed in claim 6 characterized in that a transfer member is arranged betwen the two tables.

8. A device for storing tobacco leaves or portions thereof in sandwiched relation between the windings of a belt, comprising a table having a rounded side edge, a driven roller disposed parallel to and above said rounded side edge of the table, a take-up reel upon which a belt is to be wound, means mounting said reel parallel to said rounded edge and to said driven roller for movement toward and away therefrom and for free rotation about an axis parallel thereto, supply means for issuing a belt flatwise over said table, beneath said roller and over said rounded edge and onto said take-up reel, said means mounting the reel including mechanism yieldably urging said reel toward the driven roller and said rounded edge of the table whereby to press an outermost winding of the belt on said take-up reel continuously against said driven roller, said driven roller being rotatably driven to effect winding of the belt on said take-up reel such that said belt passes over said rounded edge of the table and downardly to form, on the reel, said outermost winding and said supply means including brake mechanism which tensions said belt and therefore said outermost winding to a selected degree whereby all of the windings are uniformly tensioned independently of the increasing size of the windings on the reel and dependent only upon the frictional engagement of said driven roller against said outermost winding.

9. A device for simultaneously storing tobacco leaf portions between the windings of two belts, which comprises a pair of tables disposed in side-by-side spaced relation, each table having rounded opposite side edges, a first driven roller disposed parallel to and above the outer rounded side edge of one table and a second driven roller disposed parallel to and above the outer rounded side edge of the other table, a first take-up reel upon which a first belt is to be wound and a second take-up reel upon which a second belt is to be wound, first means mounting said first reel parallel to the outer rounded side edge said one table and to said first driven roller for movement toward and away therefrom and for free rotation about an axis parallel thereto, second means mounting said second reel parallel to the outer rounded side edge of said other table and to said second driven roller for movement toward and away therefrom and for free rotation about an axis parallel thereto, said first means including mechanism yieldably urging said first reel toward said first driven roller and said outer rounded side edge of the one table and said second means including mechanism yieldably urging said second reel toward said second driven roller and said outer rounded side edge of the other table, first and second supply means beneath said tables for respectively issuing said first and second belts to pass upwardly between said tables, over the respective inner rounded side edges of said tables, across the respective tables and then downwardly over the respective outer rounded side edges thereof and onto the respective first and second reels, said first and second supply means each including brake means for tensioning said belts to lie flatwise and taut on their respective tables, and said driven rollers engaging the outermost windings of their respective belts so that all of the windings of the two belts are uniformly tensioned independently of the increasing sizes thereof and dependent only upon the frictional engagements of the respective driven rollers against the respective outermost windings of the belts as effected by said mechanism for yieldably urging.

10. A device as defined in claim 9 wherein the opposite side edge of said table is rounded and said supply means is located below said table whereby said belts passes over said opposite side edge before passing flatwise across said table.

* * * * *